US005091611A

United States Patent [19]

Reeves et al.

[11] Patent Number: 5,091,611

[45] Date of Patent: Feb. 25, 1992

[54] SWITCH FOR PORTABLE LIGHT SOURCE

[75] Inventors: W. Clay Reeves, Dallas, Tex.; Donald L. Rohrs, Overland Park, Kans.

[73] Assignee: The Brinkmann Corporation, Dallas, Tex.

[21] Appl. No.: 566,888

[22] Filed: Aug. 13, 1990

Related U.S. Application Data

[63] Continuation of Ser. No. 434,535, Nov. 8, 1989, abandoned, which is a continuation of Ser. No. 261,786, Oct. 24, 1988, abandoned.

[51] Int. Cl.[5] ..... F21V 23/04; H01H 13/58

[52] U.S. Cl. ..... 200/60; 200/526; 362/205

[58] Field of Search ..... 200/60, 520, 523, 526, 200/527, 528; 362/187, 188, 203, 205-207

[56] References Cited

U.S. PATENT DOCUMENTS

| | | | |
|---|---|---|---|
| 1,342,322 | 6/1920 | Boulanger | 362/205 |
| 1,584,539 | 5/1926 | Hopkins | 362/188 |
| 1,607,647 | 11/1926 | Seikot | 362/206 |
| 2,134,857 | 11/1938 | Burgess | 200/60 |
| 2,443,539 | 6/1948 | Kopp | 200/60 |
| 2,599,295 | 6/1952 | Thomas | 200/60 |
| 2,677,022 | 4/1954 | Fleming | 200/60 |
| 2,818,499 | 12/1957 | Moore | 362/191 |
| 2,915,621 | 12/1959 | Garland | 362/205 |
| 2,945,111 | 7/1960 | McCormick | 200/526 |
| 3,176,092 | 3/1965 | Lukasek | 200/60 |
| 4,286,311 | 8/1981 | Maglica | 362/205 |
| 4,408,263 | 10/1983 | Sternlight | 362/189 |
| 4,458,300 | 7/1984 | Walsh | 362/206 |
| 4,484,253 | 11/1984 | Roberts | 362/206 |
| 4,527,223 | 7/1985 | Maglica | 362/187 |
| 4,577,263 | 3/1926 | Maglica | 362/187 |
| 4,733,337 | 3/1988 | Bieberstein | 362/206 |

FOREIGN PATENT DOCUMENTS 2372382 6/1978 France .

*Primary Examiner*—J. R. Scott

*Attorney, Agent, or Firm*—Pretty, Schroeder, Brueggemann & Clark

[57] ABSTRACT

A switch for a portable light source such as a flashlight which has a housing for carrying one or more batteries and for supporting a lamp bulb. The switch includes a switch body securable to the housing and an actuator that is axially moveable relative to the switch body for electrically coupling and uncoupling an electrode of the batteries to one of the terminals of the lamp bulb to switch the lamp bulb on and off. The actuator is also rotatably moveable relative to the switch body to prevent axial movement of the actuator and thereby lock the flashlight in the on state.

38 Claims, 8 Drawing Sheets

SWITCH FOR PORTABLE LIGHT SOURCE

This application is a continuation of U.S. application Ser. No. 07/434,535, filed Nov. 8, 1989 which is a continuation of U.S. application Ser. No. 261,786, filed Oct. 24, 1988 and now abandoned.

BACKGROUND OF THE INVENTION

This invention relates generally to portable light sources and, more particularly, to switches for portable light sources that are actuated through axial movement of the switch mechanism, or so-called push-button switches.

Flashlights and other portable light sources having pushbutton switches for opening and closing the electrical circuit between the lamp bulb and the source of electrical energy, typically batteries, are well-known. The ruggedness and reliability of such switches is particularly important because, in the case of most portable light source designs, if the switch fails it is not otherwise possible to illuminate the lamp bulb. Switch failure is one of the more common problems encountered with such devices. It occurs generally through malfunction of the mechanical movement of the switch mechanism or failure of the electrical contacts in the switch to make proper connection. In addition to being rugged and reliable, it is desirable that such switches have a relatively simple and inexpensive design, with components that are easily assembled to allow economical manufacture. Many prior pushbutton switches for portable light sources have not provided all these attributes.

Another concern of those involved in the design of portable light sources is preventing inadvertent operation of the switch to connect the electrical circuit when not desired. In the design of hand-held portable light sources, such switches are typically located in the handle (which in a common flashlight is its barrel or battery cell tube) so that the switch may be conveniently operated by the user's thumb while the handle is grasped in the palm of the hand. In order to diminish the risk of inadvertent operation, the switch may be recessed in the handle so that the pushbutton does not extend significantly above the handle surface.

In another type of portable light source, however, the pushbutton switch may be located where it is either undesirable or impractical to recess it. Such is the case, for example, with flashlights of the type having a pushbutton switch located in the tail cap of the flashlight. With such a flashlight, the user grasps the barrel in the palm of the hand so the thumb extends over the end of the barrel to depress the tail cap switch axially. In this orientation, the angle of the thumb does not readily permit depression of a recessed switch with ease. The pushbutton thus is designed to extend beyond the end of the barrel, but it is then susceptible to being inadvertently switched on or off. There is a need for a switch for such applications which overcomes this problem and yet is still easy to operate.

SUMMARY OF THE INVENTION

In accordance with the present invention, a switch assembly for a portable light source is provided which is rugged, reliable, and easily assembled. The switch is designed to have a multiple self-wiping action for good electrical contact when the switch is actuated and uses a contact which is also self-centering. In a further aspect of the invention, the switch can be locked in the "off" configuration to prevent inadvertent switching "on" of the lamp bulb.

The switch assembly has a push-button which is axially movable to allow ease of operation and which is rotatable for locking the switch in the "off" position. The switch assembly is adapted for use in a portable light source such as a flashlight which includes a housing for carrying a power supply, the power supply having first and second power supply electrodes. A lamp bulb is supported by the housing and has first and second lamp contacts, wherein the first lamp contact electrically couples to the first power supply electrode. Conductor means are electrically coupled to the second lamp contact wherein the power supply, the lamp bulb and the conductor means are connected in series, when the power supply is in place, to form an open circuit having first and second terminals. The switch assembly includes a switch body securable to the housing. The switch assembly also includes actuator means axially moveable relative to the switch body for electrically coupling and uncoupling the first and second terminals in the housing to thereby switch the lamp bulb on and off, and rotatably moveable relative to the switch body for substantially preventing axial movement of the actuator means and thereby locking the portable light source in either the on or off state.

In one form of the invention, the actuator means includes a push-button external to and guided by the switch body and which is axially movable to turn the portable light source on and off and rotatably movable to lock it in either the on or off state through interaction of the push-button with tangs on the switch body. This precludes inadvertent turning on of the portable light source, thereby prolonging battery life. In a further form of the invention, the actuator means may include a plunger having projections or equivalent means for engaging a pocket or recess after rotation of the plunger in order to prevent any substantial axial movement of the plunger. This would also serve to lock the portable light source on or off, thereby providing a second locking mechanism. The recess may be formed in a guide sleeve placed in the switch body for guiding the plunger in its axial and rotational movement. The projections on the plunger are then guided by the guide sleeve.

In a preferred embodiment, the plunger contacts a rotor having alternating peaks and valleys for cooperating with peaks on the plunger. The rotor also includes projections for cooperating with the projections on the plunger. The rotor follows the axial movement of the plunger and is guided by bearing surfaces in the guide sleeve. The rotor supports a preferably four-pronged contact which is insulated by the guide sleeve from the remainder of the switch body when the switch is off. The contact can be moved out of the guide sleeve, against the bias of a counteracting metal spring contacting a battery, into electrical contact with a retainer in the switch body thereby closing an electrical circuit between the spring and the switch body. In addition to its linear wiping action, the contact preferably also produces a wiping action through rotational motion of the contact as the rotor moves axially and rotationally in the guide sleeve. The four prongs serve to center the contact in the switch and provide redundant electrical contact. Rotation of the contact during actuation of the switch causes each of the four prongs in contact with the retainer to wipe against a different portion of the retainer surface than during the immediately preceding actuation of the switch.

Interaction of the plunger, rotor and guide sleeve during operation of the switch preferably produces audible clicks so that the user knows when the switch has been activated sufficiently to hold the portable light source on or to lock or unlock the switch. An audible click is produced when the actuator means is depressed sufficiently to turn the portable light source on for constant illumination, after the switch is released to keep it on, when the actuator means is depressed sufficiently to be able to turn the portable light source off, and when the actuator means is returned to its original position to keep it off. An audible click is also produced when the actuator means, while the portable light source is off, is rotated to the locked position or back again to the unlocked position. However, the switch can be turned on and held on with constant pressure on the actuator means without having the audible click produced.

Preferably a dual diameter/dual pitch spring is used to make electrical connection between the contact and one electrode coupled to the battery. The larger diameter portion of the coil spring biases the contact against the rotor and is retained within the tail cap switch by a bushing and retainer having an opening only large enough to allow the smaller diameter portion of the coil spring to extend out of the switch body for making contact with the battery.

Other features and advantages will become apparent upon considering the following more detailed description of the preferred embodiment and the claims.

BRIEF DESCRIPTION OF THE DRAWINGS

FIG. 19 is a partial side elevation and partial section view of the switch mechanism of FIG. 2 showing the rotor in a position for maintaining the flashlight on.

DETAILED DESCRIPTION OF THE PREFERRED EMBODIMENT

Figure 1:
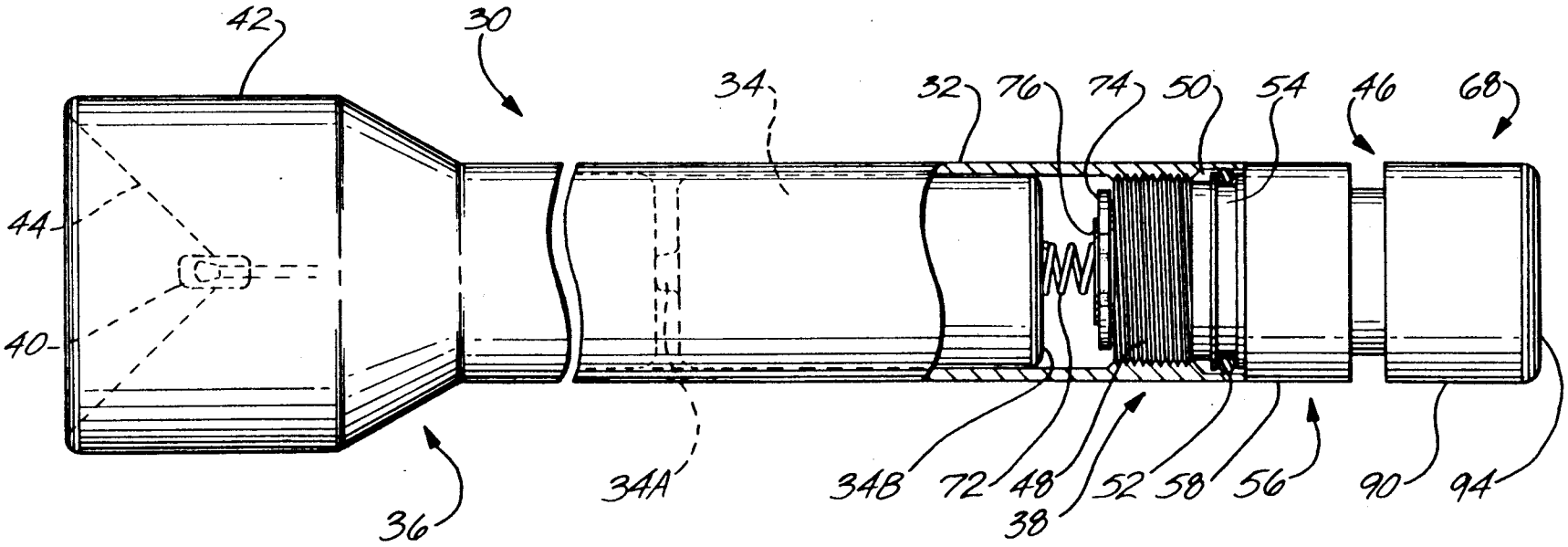
FIG. 1 shows a side elevation and partial cut away view of a flashlight having a push-button switch in accordance with a presently preferred embodiment of the invention.

The switch of the present invention is particularly suited to portable light sources, with particular application to flashlights, such as the flashlight 30 shown in FIG. 1. The flashlight includes a housing in the form of a battery cell tube or barrel 32 for holding one or more power supply elements, such as batteries 34. In many flashlights of well known design, the batteries are oriented in series and extend substantially from a first end 36 to a second end 38 of the housing. A lamp bulb 40 is located at the first end within the flashlight head or bulb enclosure 42. The bulb is located at the apex of a reflector 44, as is well known in the art. The bulb is illuminated by passing current from a positive terminal 34A to a first lamp terminal for the bulb 40 and through the bulb to a second lamp terminal. In many flashlights commonly available, the circuit then continues through the battery cell tube, such as where the battery cell tube is machined aluminum or some other conductive material, to a tail cap 46, which is in electrical contact with the negative terminal 34B of the battery. Depending on the flashlight design and the type of bulb used, there may be one or more conductors between the positive terminal 34A of the battery and the bulb and also between the bulb and the battery cell tube. Additionally, a conductor other than the battery cell tube may be used to form a continuous circuit between the bulb terminal and the tail cap.

The on/off operation of flashlights is accomplished in a number of ways, particularly for hand held flashlights such as that shown in FIG. 1. The switch for operation of the flashlight can be placed on the barrel of the flashlight, in the head or at the tail cap. In each case, the switch operates by opening and closing the circuit to the bulb, as is well known in the art. By placing the switch at the location of the tail cap, one-handed operation of the flashlight and operation of the locking feature for the switch in the present design are made easier. However, it should be understood that the switch as described more fully herein provides advantages as a result of its design apart from its location on the flashlight, and placement of the switch in the tail cap is preferred for the additional reasons discussed.

Where the switch is placed at the location of the tail cap, the barrel and the negative terminal 34B form first and second portions of the circuit which are separated from each other by the switch in the tail cap. The switch includes a switch body 56 which also serves as the tail cap closing the end of the battery cell tube and holding the batteries within the barrel. (The terms "tail cap" and "switch body" are used interchangeably because the tail cap in the preferred embodiment serves the functions both of a tail cap and a switch body.) The switch, generally, also includes an actuator including a push-button 68 (FIG. 2), plunger 120, rotor 130, guide sleeve 140, a contact 172, a coil spring 72 and bushing 76 and a retainer 74, the retainer being for retaining the rotor, contact, coil spring and bushing substantially within the switch body. In general, the push-button 68, plunger 120, rotor 130 and contact 172 are axially movable so that the contact, which is electrically coupled through the coil spring 72 to the negative terminal 34B of the battery, advances from the insulated guide sleeve 140 into contact with the conductive retainer 74 which is electrically coupled to the metallic switch body 56. This closes the circuit between the barrel and the batteries, thereby illuminating the bulb. Subsequent operation of the actuator returns the contact and the other elements to their starting positions, thereby opening the circuit. Rotation of the push-button about the central axis of the switch body serves to lock the switch, preventing any substantial axial movement of the switch, as described more fully below. As used herein, the terms "lock" and "locking" are to be interpreted broadly to include the functions of holding or blocking the flashlight switch in a particular position.

Considering the external features of the preferred embodiment of the tail cap/switch in more detail, the tail cap/switch assembly 46 is threaded into the second end 38 of the barrel through threads 48 recessed from the end of the barrel below a counterbore 50. The circumferential wall of the counterbore forms a moisture seal through an O-ring 52 seated in an O-ring groove 54 in the tail cap.

Figure 2:
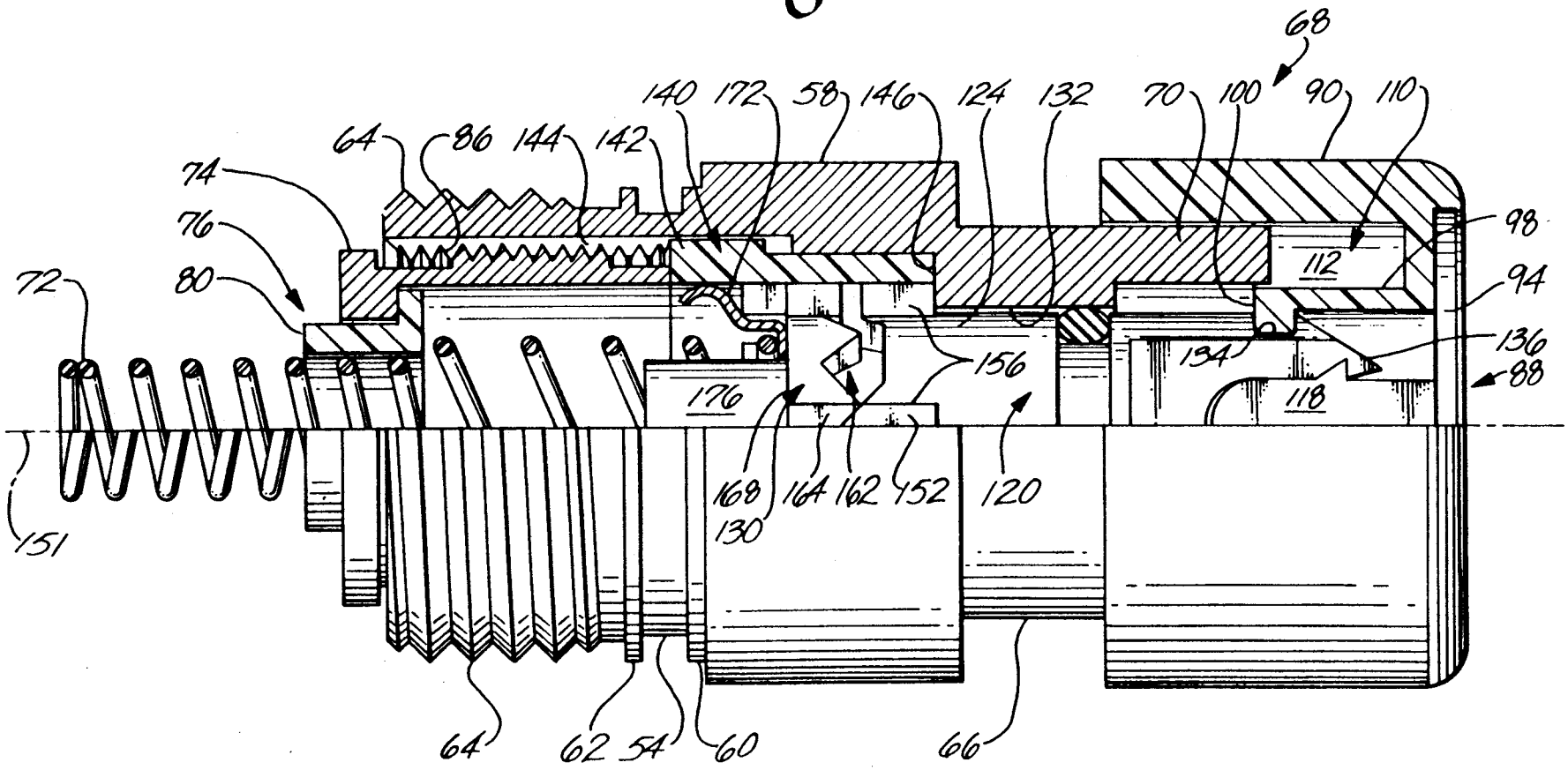
FIG. 2 is a side elevation view and partial quarter section of the tail cap and switch shown in FIG. 1.
Figure 8:
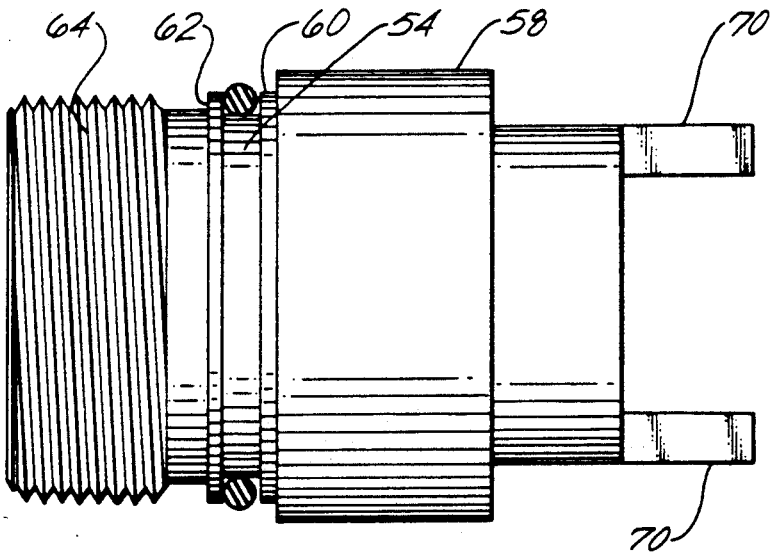
FIG. 8 is a side elevation view of a body for the tail cap and switch of FIGS. 2 and 3.
Figure 9:
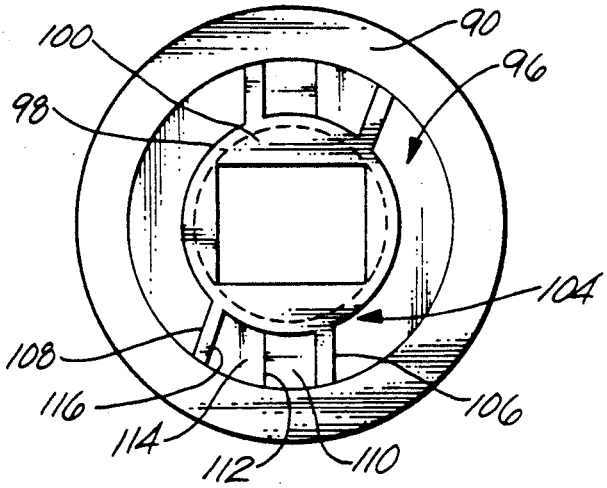
FIG. 9 is a front elevation view of the push-button of FIG. 1.

The outer surface of the switch body forms a cylindrical ring 58 having a diameter substantially identical to the outer diameter of the barrel 32. The ring 58 is at the approximate longitudinal center of the switch body. The ring extends toward the barrel and terminates at a land 60 for the O-ring groove 54 (FIGS. 2 and 8). The O-ring groove is bounded on the opposite side by a second land 62. The switch body includes external threads 64 for engaging the internal threads 48 formed in the second end 38 of the barrel, and the switch body can be threaded into the 38 barrel so that the second end seats against the edge of ring 58. Threaded engagement of the switch body and barrel continues part of the electrical circuit from the barrel into the switch body.

The remainder of the switch body 56 on the side of the ring 58 opposite the threads 64 includes a reduced-diameter cylindrical portion 66 for accepting and guiding a push-button 68 (FIG. 2), which forms a part of the axially movable actuator means. The reduced-diameter cylindrical portion terminates in a transverse surface from which extend a pair of diametrically oppositely disposed projections or tangs 70 having rectangular transverse cross-sections. The tangs have a larger radial dimension than tangential dimension and have a function described more fully below.

Figure 12:
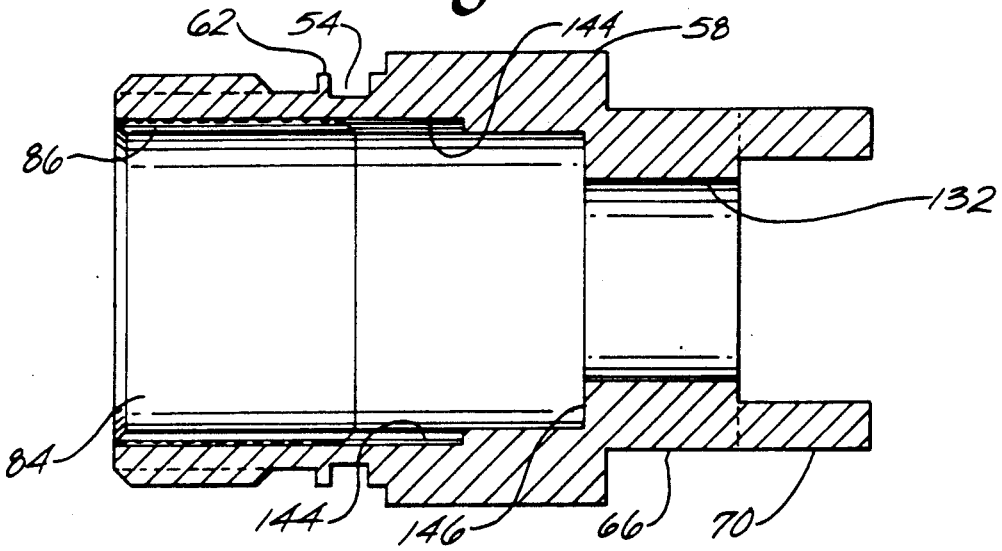
FIG. 12 is a side section of the body of FIG. 8.
Figure 14:
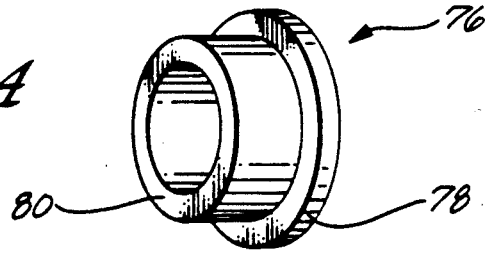
FIG. 14 is a front perspective view of a bushing to be placed on the reduced diameter section of the coil spring of FIG. 13.
Figure 15:
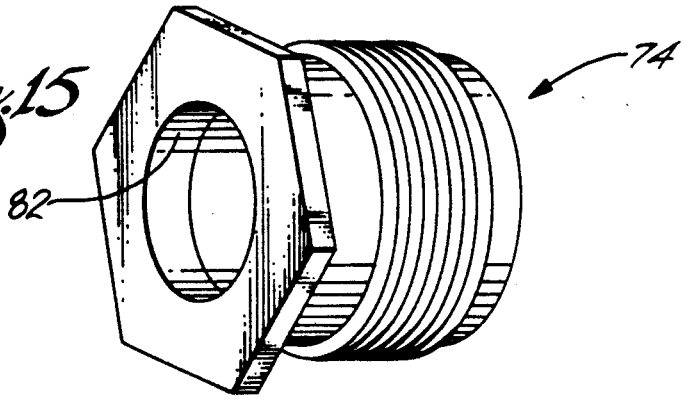
FIG. 15 is a front perspective view of a retainer for the switch of FIG. 1.

Also external to the tail cap 46 is part of a conductive means in the form of a dual-diameter, dual-pitch coil spring 72, extendable from the body 56 (FIGS. 1 and 2). The spring makes electrical contact with an electrode of the battery when the tail cap is threaded onto the second end 38 of the barrel 32 and when the battery 34 is held in the barrel. The spring also serves to bias the battery or batteries away from the tail cap and into electrical contact (not shown) with a contact coupled to the bulb 40. The spring is held in the end of the switch body by a retainer 74 and is electrically insulated from the retainer and the switch body by a rubber or a plastic bushing 76. The bushing includes a ring 78 (FIG. 14) for encircling the reduced diameter portion of the coil spring and seating against the larger diameter portion of the spring. The bushing 76 includes a cylindrical section 80 extending upwardly from the ring which also encircles the reduced diameter section of the spring and extends through an opening 82 in the exposed end of the retainer 74 (FIG. 15) so that the spring does not contact the retainer. The opening 82 is formed in the end of the retainer which includes wrenching flats for threading the retainer for engaging internal threads 86 in a bore 84 of the switch body (FIG. 12).

Figure 10:
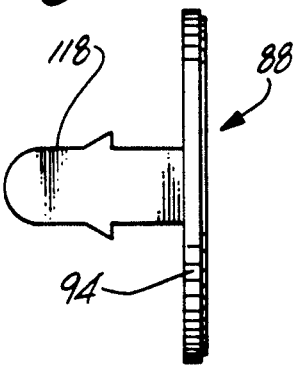
FIG. 10 is a side elevation view of a push-button lock.

The push-button 68 is substantially cup-shaped, having a cylindrical wall or skirt 90 and an end 92 closed by a push-button lock 88 (FIGS. 2 and 10) having a disk 94 for covering the end 92. The skirt is axially slidable over and rotatable about the cylindrical surface 66 of the switch body 56. The skirt protects the switch plunger and other internal parts from damage due to impact side loads against the push-button. The skirt defines an internal cavity 96 whose depth is almost equivalent to the axial length of the skirt. A cylindrical wall or second skirt 98 extends from the base of the cavity internally approximately halfway to the open end of the cavity. The second skirt is capped off by a cap 100 defining a rectangular opening 102, the portions of the cap 100 which extend radially inward from the second skirt 98 forming a ledge to be engaged by a portion of a plunger (described below).

The cavity of the push-button includes a pair of segments 104 corresponding to the pair of tangs 70 on the switch body. Each segment 104 is complementary to the other and, therefore, only one segment will be described hereafter. The segment is defined by first and second walls 106 and 108, respectively, extending upwardly coextensive with the second skirt 98. Neither of the first and second walls are located on a diameter. The space between the walls define an arc through which the push-button may rotate, the outer limits of the arc being defined by contact between the walls 106 and 108 and the corresponding sides of the respective tang 70. Preferably, the arc is approximately 22°. The arc approximates the amount of rotation accomplished by the push-button and by the plunger in order to lock the tail cap switch, thereby preventing axial movement of the push-button and plunger.

The first wall defines a first cavity 110 for receiving or into which the tang extends, thereby allowing axial movement of the push-button relative to the switch body. The first cavity 110 extends to the bottom of the overall cavity 96. The first cavity is defined on the other side by a wall 112 forming a ledge or shelf extending between the wall 112 and the second wall 108. The shelf 114 is slightly below the ends of the first and second walls 106 and 108, respectively. In the unlocked condition, with the push-button in a first rotational position, the push-button can move axially relative to the tangs 70 and the switch body, thereby allowing the flashlight to be turned on and off. When the push-button is rotated such that the end of the respective tang is opposite, or in alignment, with the shelf 114, the shelf prevents any substantial axial movement of the push-button. The second wall defines a stop surface 116 against which the tang abuts upon rotation of the push-button. The interaction of the tangs and the sectors 104 form a locking mechanism for locking the switch in the "on" or "off" position. When the switch is locked in the "off" position, axial movement of the actuator means is prevented. Additionally, as described more fully below, rotation of the actuator means also serves to disengage the plunger lugs from the rotor lugs thereby resulting in a dual locking mechanism.

Figure 11:
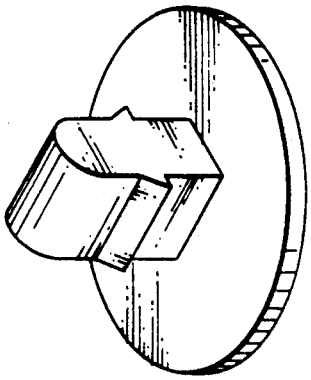
FIG. 11 is a perspective view of the push-button lock of FIG. 10.

The push-button cap 88 (FIGS. 2, 10 and 11) closes the end of the push-button. The push-button cap includes an insert post 118, extending perpendicularly from the center of disk 94, preferably having a rectangular transverse cross-section and a curved end. Two opposing sides (the wider sides) include a locking ridge extending width-wise across each side for engaging corresponding notches at the end of the plunger. Each locking ridge includes a ramp sloping upward from an approximately middle portion of the insert post in a direction toward the disk and terminates in an edge perpendicular to the side. The push-button lock serves to lock the push-button and plunger together so that axial movement of the push-button moves the plunger axially and rotation of the push-button rotates the plunger.

The internal elements of the switch will now be described. The push-button engages a preferably plastic plunger 120 for axially and rotatably moving the plunger with respect to the switch body 56. The plunger includes a link body 122 and a cylindrical plunger body 124 extending on respective sides of an O-ring 126 encircling the plunger in an O-ring groove. The link body 122 links the plunger to the push-button. The plunger body 124 co-acts with the guide sleeve 140 while operating on the rotor 130.

The link body includes a pair of oppositely facing externally rounded sides for passing through a reduced diameter bore 132 in the switch body (FIGS. 2 and 12). The O-ring 126 engages the cylindrical wall of the bore for protecting the interior of the switch body from moisture and other foreign matter and also for creating a drag force with the bore. The dimensions of the O-ring and of the rounded sides are such as to allow both axial and rotational movement of the plunger within the switch body.

The link body 122 also includes a pair of oppositely facing flat sides connecting the rounded sides so that the link body can fit through the rectangular opening 102 in the push-button. Each rounded side of the link body 122 includes a groove 134 at the end of a transversely extending ramp 136 extending upwardly between the end of the link body 122 and the groove. The ramps facilitate insertion of the link body into the rectangular opening in the push-button. The ramps force the rounded sides of the link body to move inwardly as the link body is passed into the rectangular opening. When the grooves 134 engage corresponding walls in the push-button opening, the rounded sides of the link body spring outwardly approximately to their original configuration. The thickness of the walls forming the rectangular opening in the push-button are approximately the same as the width of the grooves 134. This engagement of the link body with the push-button allows any axial or rotational motion of the push-button to be translated to the plunger 120.

The push-button cap 88 engages the link body in a substantially U-shaped groove 137 in the link body 122 extending from one flat surface to the other. The U-shaped opening extends along the same diameter as that connecting the tangs 70 of the switch body. The groove substantially conforms to the insert post 118 on the push-button lock and includes slots 138 for engagement with the respective locking ridges on the insert post 118. The lead-in surface for the U-shaped opening is sloped to facilitate insertion of the insert post 118 and the locking ridges thereon into the U-shaped opening. In order to accommodate the locking ridges, the walls of the U-shaped opening spread slightly until the locking ridges engage the slots 138. In this configuration, the push-button cap 88 sandwiches the push-button between the disc 94 and the plunger link body 122. The remainder of the plunger extends along the bore 132 of the switch body and into a preferably plastic cylindrical guide sleeve 140.

Figure 3:
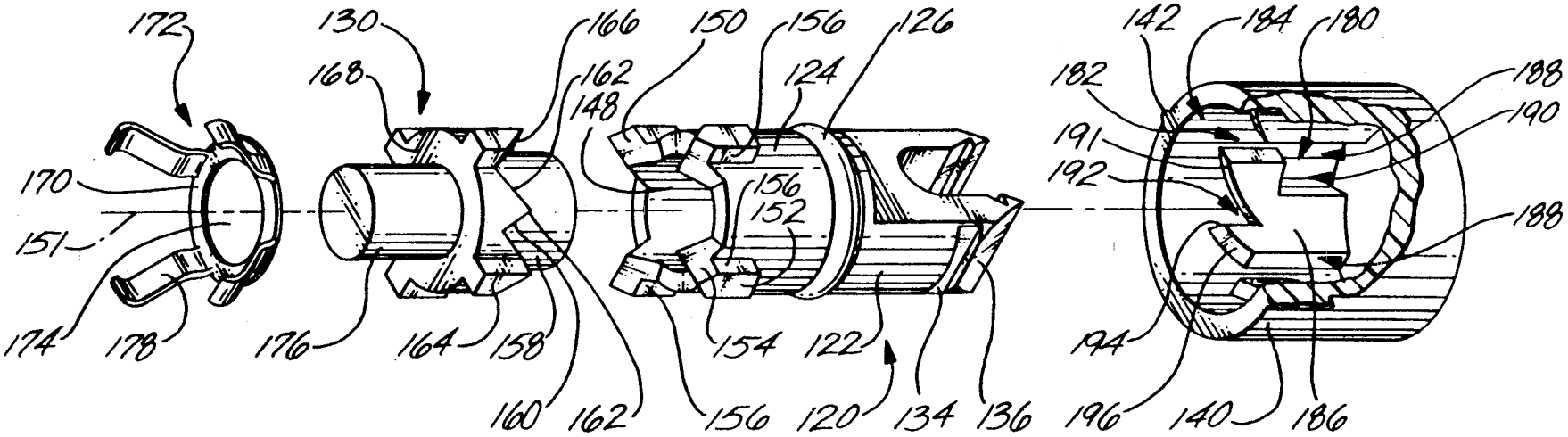
FIG. 3 is an exploded perspective view of four components of the switch of FIG. 2.
Figure 4:
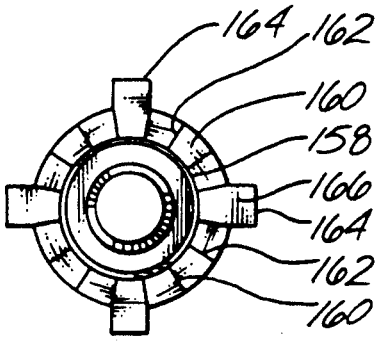
FIG. 4 is an end elevation view of a rotor in the switch of FIGS. 2 and 3.
Figure 5:
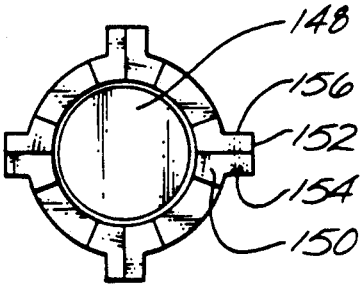
FIG. 5 is a front elevation view of the plunger in the switch of FIGS. 2 and 3.
Figure 6:
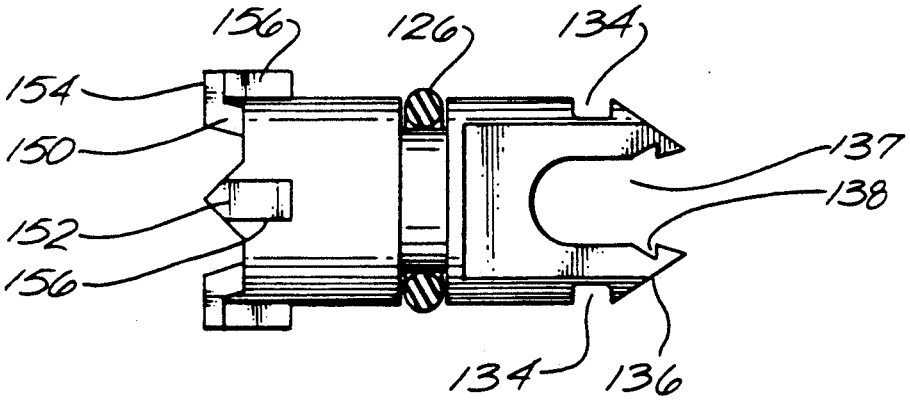
FIG. 6 is a side elevation view of the plunger of FIG. 5.
Figure 7:
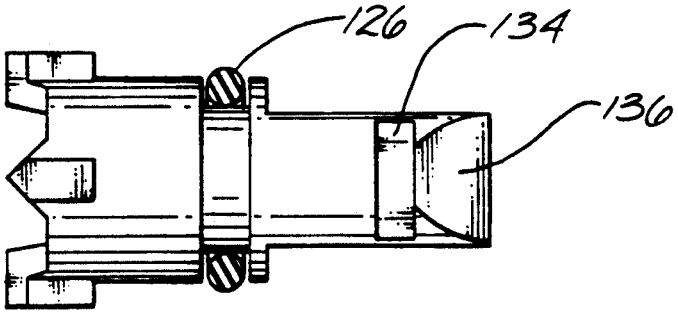
FIG. 7 is a top plan view of the plunger of FIG. 5.

The guide sleeve 140 (FIGS. 2 and 3) includes diametrically oppositely facing ribs 142 on the outside surface for engaging corresponding grooves 144 in the bore 84 of the switch body. The guide sleeve seats down against the bottom surface 146 of the bore of the switch body. The ribs 142 are at the end of the guide sleeve closest to the batteries. The guide sleeve has guide surfaces for guiding axial movement of the plunger and both axial movement and rotational movement of the rotor 130. The guide sleeve also provides a lock zone for the plunger such that axial movement of the plunger is prevented when the plunger is rotated a certain amount relative to the guide sleeve. The internal configuration of the guide sleeve accomplishing these functions will be described more fully below after consideration of the plunger and rotor in more detail.

The cylindrical plunger body 124 is substantially circular in transverse cross-section and defines a bore 148 into which a cylindrical portion of the rotor fits so that the rotor can rotate relative to the plunger. The cylindrical plunger body terminates in a rim having preferably four axially-directed points each formed by a pair of primary cam surfaces 150 oriented preferably 45 degrees to the central axis 151 of the switch and converging to an apex defining the point. Each point is oriented diametrically opposed from another and extends parallel to the central axis of the plunger body.

Formed on the circumferential face of the cylindrical plunger body 124 are full lugs 152, one full lug corresponding to each of the points forming the primary cam surfaces 150. Each of the full lugs 152 have a pair of secondary cam surfaces 154 co-planar or flush with each of the primary cam surfaces on the corresponding point. The secondary cam surfaces are not coextensive with the primary cam surfaces and terminate at longitudinally extending guide surfaces 156 for engaging corresponding guide surfaces in the guide sleeve 140. The lugs extend only a portion of the length of the cylindrical plunger body 124.

The rotor 130, referred to above, engages the plunger and supports and moves the contact 172. The rotor includes a cylinder 158 for insertion into the bore 148 of the plunger and which is long enough to ensure that it remains inserted during normal operation of the switch. The rotor also includes alternating peaks 160 and valleys 162 so that there are twice as many peaks on the rotor as there are points on the plunger. The peaks and valleys have primary bearing surfaces which extend outwardly a distance equivalent to the corresponding distance for the primary cam surfaces on the plunger. Therefore, the peaks and valleys of the rotor engage the primary cam surfaces 150 on the plunger. The peaks and valleys on the rotor constitute primary cam followers. Corresponding to every other peak on the rotor, the rotor includes half lugs 164, one of which also corresponds at any given time to a respective full lug 152 on the plunger. Each half lug includes a secondary bearing or cam follower surface 166 oriented preferably at 45° to the central axis of the switch to follow the mating secondary cam surface on the full lug of the plunger. The secondary cam follower surface 166 is coextensive with the primary cam follower surface on the corresponding peak. However, each half lug omits the complementary portion or other half of a full lug in order to facilitate coaction of the half lugs with the guide surfaces in the guide sleeve 140. The peaks and valleys and the half lugs terminate in a transversely extending contact support surface 168 which supports the base 170 of the metal contact 172.

The contact 172 electrically couples the coil spring to the retainer 74, and therefore the switch body, to turn the flashlight on. The contact includes an opening 174 for passing the base of the contact around a cylindrical contact support 176 on the rotor. The contact preferably includes four resilient leaf portions for increased electrical contact and to serve a self-centering function. Each leaf portion has a rectangular transverse cross-section and extends radially outward from the base of the contact and axially toward the battery portion of the flashlight. The end of each leaf curves inward toward the central axis of the switch so that the square end of each leaf does not come into contact with the switch body. Preferably only intermediate portions of each leaf make contact with any other portion of the switch. It is also preferred that contact occurs at two points on the intermediate portions of each leaf, i.e., at the side edges. This adds redundancy in the electrical contact and increases the linear and rotational self-wiping action.

Figure 13:
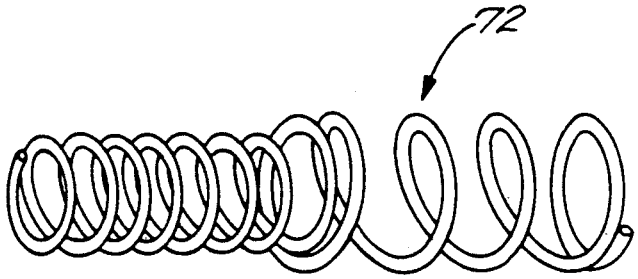
FIG. 13 is a front perspective view of a dual diameter, dual pitch spring used in the switch of FIG. 1.

The coil spring 72 is supported by the base 170 of the contact and provides a forward bias for the batteries and a backward bias for the rotor and plunger. The coil spring also provides an electrical contact between one electrode of the battery and the contact 172. The coil spring 72 is preferably a dual diameter, dual pitch coil spring (FIG. 13) with the larger diameter, larger pitch portion extending between the contact base and the bushing 76 and the smaller diameter, smaller pitch portion extending from the bushing 76 to make contact with the battery. By having the two diameters and pitches, variations in battery sizes or the number of batteries do not affect the bias on the rotor and plunger as much as would occur with a single diameter, single pitch spring. The larger diameter portion provides more electrical contact between the spring and the contact 172, and provides a ledge against which the ring 78 of bushing 76 can bear to provide the necessary amount of tension between the bushing and the contact and rotor. The spring also acts as a buffer for the contact and rotor whereby differences in compression of the reduced diameter portion due to different battery sizes does not significantly affect the amount of compression of the large diameter portion between the bushing and the contact in the rotor. A single diameter spring would also function adequately if the center of the spring is fixed relative to the switch body so that compression by the batteries does not affect the bias on the rotor and the plunger.

When the flashlight switch is in the "off" position, part of the plunger and the rotor, all of the contact and a portion of the coil spring fit into the guide sleeve 140. The guide sleeve, when used with a plunger and rotor having four lugs, has four sectors, each of which is identical with the other three. Therefore, only one sector will be described hereafter. Each sector takes up approximately a 90° angle and extends axially to each end of the guide sleeve. Axially, the guide sleeve can be separated into three zones, a lock zone 180, for locking the plunger against axial movement, an intermediate rotor control zone 182, for controlling the axial movement and rotation of the rotor and, therefore, the contact, and a contact zone 184, for holding the contact 172 entirely within the plastic guide sleeve thereby maintaining an open circuit. Each sector includes a boss 186 defining bearing surfaces for guiding the lugs on the plunger and rotor. The bearing surfaces do not affect the primary cam surfaces. A groove 188 extending from the base end of the guide sleeve up to the contact zone 184 guides the axial movement of the plunger through the full lugs 152. The lugs on the plunger can move from the base of the guide sleeve substantially to the contact zone. The lock zone includes a pocket 190 into which the full lug 152 of the plunger can be rotated from a first angular position in the groove 188 to a second angular position in the pocket 190 whereby the point of the lug is directly in alignment with a portion of the boss 186. In this plunger position, the boss prevents forward axial movement of the plunger.

One side surface on the boss defining the groove 188 terminates at a backwardly sloping, half lug bearing surface 191 for guiding a half lug 164 on the rotor to a recess for the flashlight "on" position. This position is defined by a valley 192 in the guide surface. The opposite side of the valley is defined by an axially directed bearing surface 194 against which the half lug rests when the rotor is in the "on" position. The bearing surface 194 also serves to guide the half lug upward upon being pushed by the plunger. The bearing surface 194 terminates in a second sloping bearing surface 196 for the "off" position which guides the half lug back into the next groove 188. The sloped bearing surface 191 corresponding to the "on" position is longer than the sloped bearing surface 196 so that the rotor can rotate further with respect to the peaks on the plunger sufficiently to advance the peaks 160 on the rotor past the respective points on the plunger.

The switch body is preferably formed from a conductive material such as aluminum. The O-rings are standard items, and the push-buttons, push-button lock, plunger, rotor, and guide sleeve are preferably plastic. The bushing 76 is preferably plastic. The spring and the contact are metallic as would be known to those skilled in the art. The materials available for the remaining portions of the flashlight are well known to those skilled in the art and selection of materials will depend on the end use, etc.

Assembly of the switch will now be described. The guide sleeve 140 is placed in the switch body 56 and the ribs 142 aligned with the corresponding grooves 144 in the switch body. The ribs on the guide sleeve provides initial alignment of the plunger with the tang on the switch body. It also prevents rotation of the sleeve in the switch body. The plunger is then inserted into the guide sleeve so that the full lugs pass along the grooves 188 and so that the link body 122 passes substantially through the reduced diameter bore 132 in the switch body. The link body is inserted into the bore of the push-button 68 such that the arcuate sides of the link body are pressed inward until the external grooves 134 engage the sides of rectangular opening 102. The push-button cap 188 is then inserted into the opposite end of the push-button so that the insert post 118 is inserted into the U-shaped groove in the link body 122. When the push-button cap is seated, the locking ridges on the insert post will engage the slots 138 in the walls of the U-shaped groove. By locking the push-button to the plunger, the plunger and push-button cannot be disassembled without destroying one or more of the components. This ensures that one or more of the parts are not lost upon otherwise inadvertent disassembly of the switch.

The rotor and contact are then inserted into the open end of the switch body so that the cylinder 158 of the rotor rests in the bore 148 of the plunger. The plunger will be oriented in the guide sleeve such that the full lugs lie in the corresponding grooves 188. The cylinder 158 is larger in diameter than the contact support 176 so that the rotor will not be inadvertently reversed on assembly. The positioning of the rotor is otherwise immaterial since the half lugs will either fall in the grooves 188 or the valleys 192. The coil spring can then be installed on the cylindrical contact support 176 of the rotor and the rubber bushing placed over the reduced diameter portion of the coil spring. The retainer 74 is then threaded into the end of the switch body through complementary internal threads in the bore of the switch body. The retainer is dimensioned so that the end adjacent the guide sleeve abuts the mating end of the guide sleeve and so that the internal diameter of the guide sleeve is less than or equal to that of the retainer so that there is an easy transition for the leaf portions 178 of the contact when traveling from the contact zone in the guide sleeve to the internal bore of the retainer. When the retainer is fully threaded or seated, there is preferably a gap remaining between the underside of the wrenching flats of the retainer and the end of the switch body. The bushing supports the coil spring laterally as the tail cap is screwed in. The bushing also floats with respect to the retainer to the extent that the bushing extends outside the retainer. When the spring is depressed by the battery, the bushing moves slightly with the spring. Upon final assembly, the switch can be threaded onto the barrel and will appear as shown in FIG. 1.

With the above-described embodiments, the flashlight is particularly suited for one-handed operation. The barrel of the flashlight can be grasped such that the push-button can be rotated between the thumb and the forefinger from the locked to the unlocked position and back again. The flashlight can be easily turned on by applying pressure to the push-button by either the thumb or one of the fingers.

Figure 16:
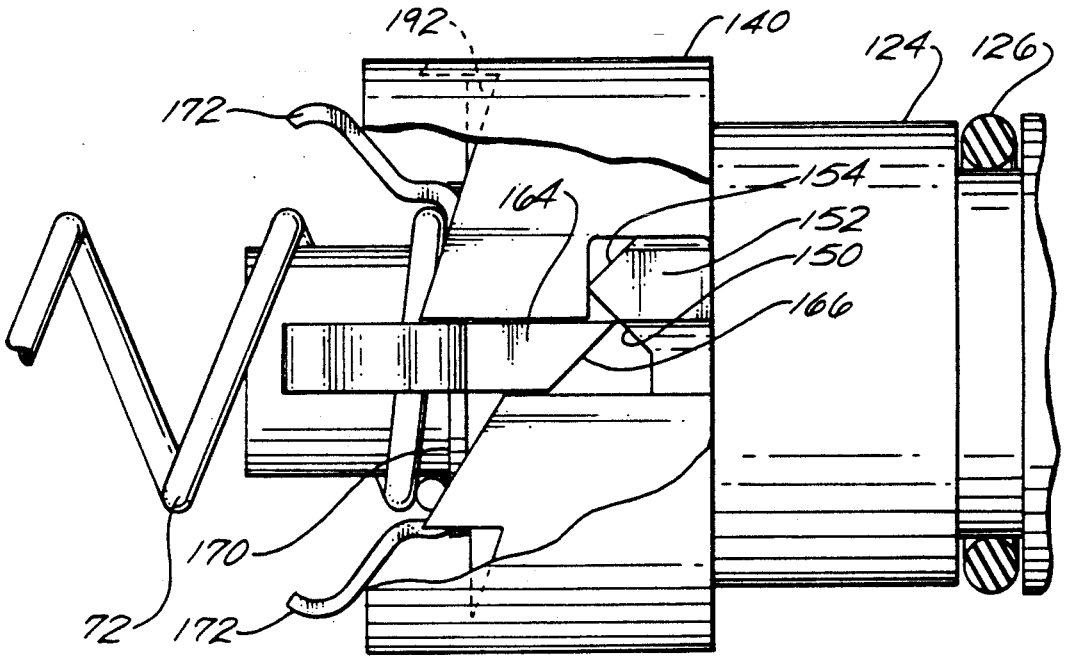
FIG. 16 is a partial side elevation and partial section view of a portion of the switch mechanism of FIG. 2 showing the plunger in a locked position.
Figure 17:
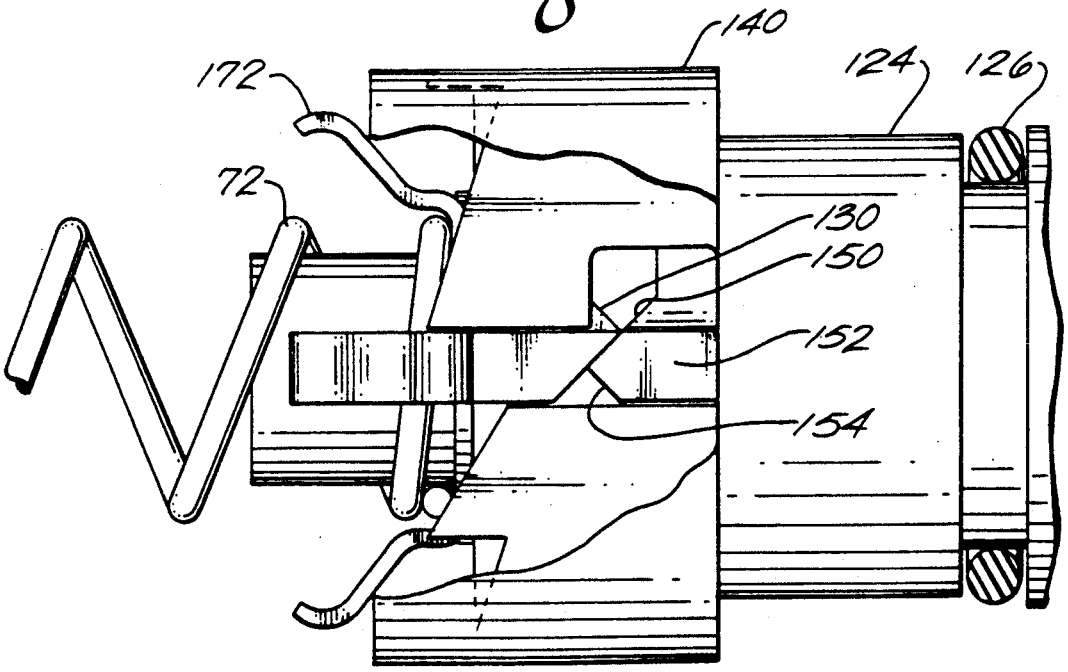
FIG. 17 is a partial side elevation and partial section view of the switch mechanism shown in FIG. 2 with the plunger in an unlocked position.

Operation of the switch will now be described. It will be assumed that there exists a complete circuit between one electrode of the battery immediately adjacent the switch and the end of the barrel into which the tail cap is threaded. This may take any number of configurations. Moreover, the particular form of the electrical connection between the switch and the battery and between the switch and the circuit in the barrel can also take any number of configurations. Considering the disclosed embodiment, FIGS. 16 and 17 show the switch in the locked and unlocked configurations, respectively. The flashlight is off and the contact 172 is housed entirely within the guide sleeve 140. The plunger and, therefore, the corresponding full lugs 152 are rotated to a second position shown in FIG. 16 from a first position shown in FIG. 17. Each point is contained in its corresponding pocket 190 in the guide sleeve, thereby preventing axial movement, in the direction right to left as shown in FIG. 16. In that configuration, it should be understood that the push-button has also been rotated to an angular position such that the tangs on the switch body are directly opposite the corresponding shelf 114 in the cavity 96 of the push-button. Further rotation of the push-button and of the plunger is prevented by the stop surface 116 and the side of the pocket 190, respectively. Also in this configuration, the primary cam surface 150 on the plunger is adjacent the corresponding primary cam follower surface on the rotor 130 (Compare FIGS. 16 and 17) Because these two surfaces are adjacent one another, rotation of the plunger back to the position shown in FIG. 17 is facilitated. Movement of the point on the half lug over the secondary cam surface on the full lug is facilitated. Additionally, movement of the half lug over the point on the full lug and back down to the position shown in FIG. 17 produces an audible click indicating that the motion has been completed. An audible click is also produced upon rotation of the plunger in the opposite direction for the same reason.

With the configurations shown in FIGS. 16 and 17, the rotor is in its lowest point of equilibrium, the plunger is unextended and the larger diameter portion of the coil spring is in its most expanded configuration. Additionally, each of the four leaves on the contact bear against the inside plastic surface of the guide sleeve.

In order to turn the flashlight on, the push-button 68 is depressed, thereby pushing the plunger axially forward toward the batteries of the flashlight. The O-ring 126 on the plunger slides within the reduced diameter bore 132 in the switch body. The primary and secondary cam surfaces on the plunger engage the corresponding primary and secondary cam follower surfaces on the rotor to push the rotor against the opposing force of the coil spring. The rotor is prevented from rotational movement by the sidewalls of the groove 188. But for the presence of the sidewalls of the groove, the half lug on the rotor would slide down toward the rim of the plunger along the secondary cam surface on the full lug of the plunger.

As the plunger and rotor advance, the leaves of the contact move from the end of the guide sleeve into the bore of the retainer, thereby making electrical contact with the retainer. This closes the electrical circuit for the flashlight bulb and illuminates the bulb. At the transition between the guide sleeve and the retainer, the half lug of the rotor is still retained between the walls of the groove 188. Therefore, when the flashlight is unlocked, the flashlight can be turned on with a minimum of motion and without any audible click being produced, as occurs when the half lug rotates after leaving the confines of the groove 188. If the push-button is released before the rotor rotates along the guide sleeve, the plunger and rotor will return to their respective positions shown in FIG. 17. This allows silent use of the flashlight when necessary during law enforcement work and the like.

Figure 18:
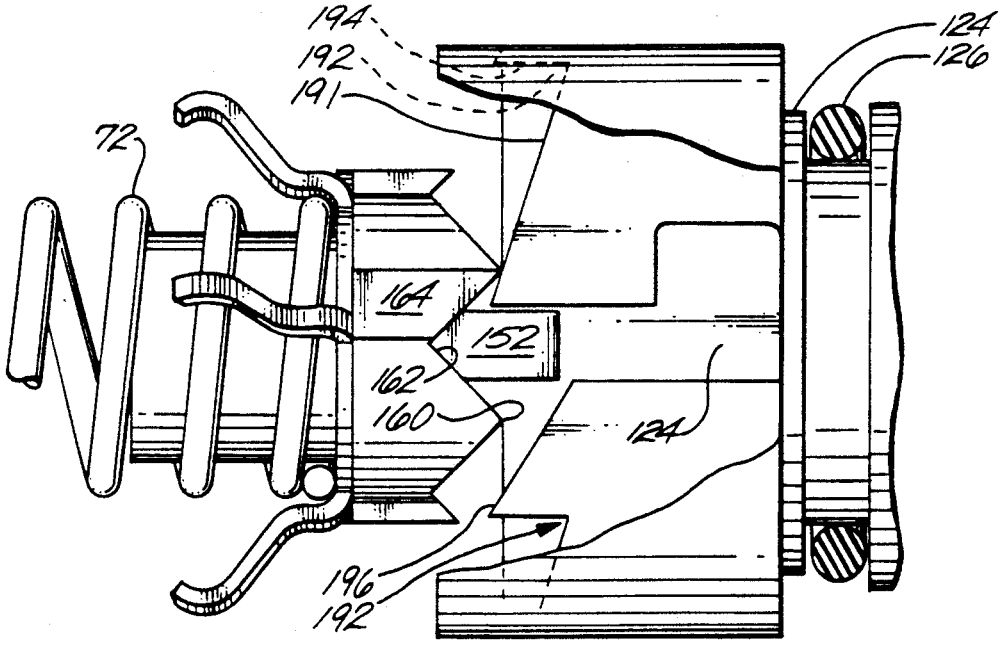
FIG. 18 is a partial side elevation and partial section view of the switch mechanism of FIG. 2 showing the plunger advanced to compress the coil spring.

Upon further depression of the push-button, the tip of the half lug clears the side edge of the channel 188. The spring bias from the coil spring along with sloped surface of the half lug and of the bearing surface 191 cause the rotor to rotate to the position shown in FIG. 18 when the push-button is fully depressed and the plunger has moved its full axial extent. The contact also rotates with the rotor to same extent half lug moves along the bearing surface 191. In this configuration of the push-button, the tangs have reached the bottom of the cavity 110 in the push-button. The O-ring on the plunger, however, is still pressed between the O-ring groove and the reduced diameter bore in the switch body. An audible click is produced when the valley 162 of the rotor reaches the point of the primary cam surfaces on the plunger.

When the push-button is released, the bias of the coil spring forces the rotor, plunger and contact axially rearward as the point on the half lug slides along the sloping surface toward the valley 192. The rotor rotates slightly beyond an angle of 45° from the groove 188 to the valley 192. The peaks and valleys intermediate the half lugs do not interfere with the rotation of the rotor except to the extent that the primary cam surface 150 on the plunger slides along the primary cam surface on the peak 160 of the rotor, because only the follower surface on the half lug contacts the bearing surfaces on the guide sleeve. Upon continued rotation of the rotor in response to the bias of the coil spring, the plunger is pushed back sufficiently until the half lug comes to rest in the corresponding valley 192. In this position, the peak 160 has rotated beyond the corresponding point on the primary cam surfaces of the plunger. In the configuration shown in FIG. 19, the contact has rotated slightly more than 45° all the while achieving a wiping action between the edges of each portion of the leaf which is in contact with the surface of the bore in the retainer. The wiping action is both as a result of the axial movement of the contact and the rotational movement of the contact achieved through rotation of the rotor. This enhances flow of current while the circuit is closed. While the contact rotates with the rotation of the rotor, it does not necessarily rotate an equal amount with the rotor with every operation of the switch. Rotation of less than 45° may occur.

Figure 19:
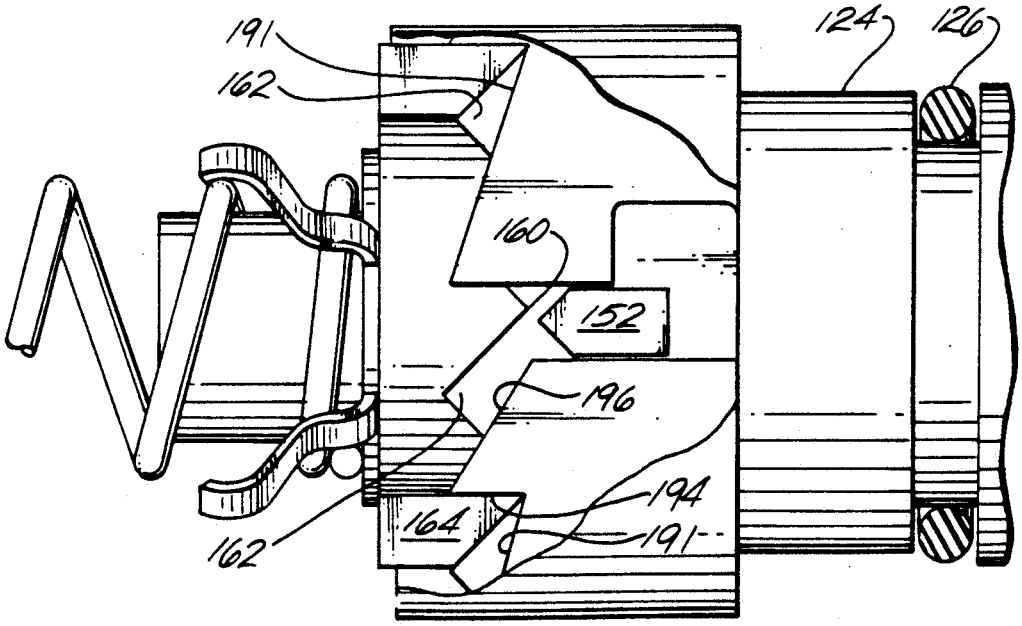

In the configuration shown in FIG. 19, the plunger can be manually retracted sufficiently to allow it to be rotated back into the pocket 190 in the guide sleeve. This occurs simultaneously with the orientation of the push-button with the tang so that the tang and its corresponding shelf are in alignment. This in effect locks the flashlight on. However, the only bias preventing return of the push-button or plunger to the position shown in FIG. 19 is the friction created between the O-ring 126 and the bore of the switch body. This may be overcome by pushing on the push-button after rotation of the push-button to the unlocked position. The plunger O-ring 126 contributes a desirable uniform resistance or drag force which smooths out the switch operating forces. It also keeps the actuator components (i.e., the plunger and push-button) in position when the switch is on and no spring bias is being applied to them.

In order to return the tail cap switch to the configuration shown in FIG. 17 the push-button is depressed, thereby moving the plunger forward against the rotor. The primary cam surfaces on the plunger contact the primary cam surfaces on the peaks of the rotor pushing the rotor against the bias of the coil spring. As soon as the longitudinal side surface of the half lug clears the bearing surface 194 in the guide sleeve, the half lug travels down the bearing surface 196 and back into the groove 188. The rotor and contact will then have moved 90 degrees. The plunger can be rotated as before to relock the switch.

With the flashlight having a switch in the above-described embodiment, the skirt of the push-button is guided along the outside of the switch body. The push-button is substantially prevented from rocking due to any side impacts against the push-button. This is due both to the close proximity of the skirt to the switch body and to the fixed interconnection between the push-button and the plunger. Having the skirt extend over the side of the switch body also allows for easy manipulation for rotating the push-button between the locked and unlocked positions. The interaction of the tangs with the push-button also serves a locking function which combines with the locking function of the plunger and the guide sleeve. Preferably, the locking function through the tail cap is equivalent to the locking function served by the plunger.

Use of a plunger and rotor and corresponding cam and following surfaces causes rotation of the contact and therefore provides a wiping action through the contact and also provides for audible clicks during action of the switch mechanism. Moreover, by having the circuit close upon partial advance of the push-button and plunger, a momentary "on" configuration for the flashlight can be achieved without creating an audible click.

Importantly, the plunger and rotor are not in stable equilibrium when the full lug and half lug are in alignment except for the fact that they are retained within the groove 188. As a result, as soon as the half lug is freed from the confinement of the groove 188, it can rotate freely in response to the bias of the coil spring.

It should be noted that the above are preferred configurations, but others are foreseeable. The described embodiments of the invention are only considered to be preferred and illustrative of the invented concept. The scope of the invention is not to be restricted to such embodiments. Various and numerous other arrangements may devised by one skilled in the art without departing from the spirit and scope of the invention.

We claim:

1. In a portable light source such as a flashlight which includes a housing for carrying a power supply, the power supply having first and second power supply electrodes, a lamp bulb supported by the housing and having first and second lamp contacts wherein the first lamp contact electrically couples to the first power supply electrode, and conductor means electrically coupled to the second lamp contact wherein the power supply, the lamp bulb and the conductor means are connected in series to form an open circuit having first and second terminals, the improvement comprising:

a switch assembly including a switch body securable to the housing and actuator means axially movable relative to the switch body for electrically coupling and uncoupling the first and second terminals in the housing and thereby switching the lamp bulb on and off, and rotatably movable relative to the switch body for substantially preventing axial movement of the actuator means and locking the flashlight in either the on or off state.

2. The light source of claim 1 wherein the housing comprises a conductive barrel and wherein the switch body comprises a conductive material.

3. The light source of claim 1 wherein the switch body comprises a conductive material and a bore for accepting a portion of the actuator means, and further comprising a conductor extending from the switch body for contacting the second power supply electrode and isolating means for electrically isolating the conductor from the switch body when the portable light source is off.

4. The light source of claim 3 wherein the conductor comprises a longitudinally extending spring and wherein the isolating means comprises a bushing surrounding a portion of the spring.

5. The light source of claim 3 wherein the actuator means further comprises a contact in the switch body electrically coupled to the conductor and electrically isolated from the switch body when the actuator means is in a first axial position by a plastic sleeve in the switch body.

6. The light source of claim 5 wherein the switch body further comprises a conductive surface for electrically coupling the contact to the switch body when the actuator means is in a second axial position.

7. The light source of claim 6 wherein the conductive surface comprises a metallic retainer having an internal diameter and wherein the plastic sleeve comprises an internal diameter substantially the same as the retainer internal diameter.

8. The light source of claim 5 wherein the contact comprises at least two leaf portions rectangular in transverse cross-section for electrically coupling to the switch body when the light source is switched on.

9. The light source of claim 3 wherein the conductor comprises a dual diameter coil spring biasing the actuator means away from the coil spring.

10. The light source of claim 3 wherein the conductor comprises a dual pitch coil spring.

11. The light source of claim 1 wherein the actuator means comprises an axially and rotatably movable push-button and wherein rotation of the actuator means comprises rotation of a surface on the push-button relative to the switch body.

12. The light source of claim 11 wherein the switch body comprises projections and wherein rotation of the push-button causes the projections to prevent appreciable axial movement of the push-button.

13. The light source of claim 11 wherein the actuator means comprises an axially movable plunger in the switch body coupled to the push-button and wherein rotation of the push-button rotates the plunger.

14. The light source of claim 13 wherein the switch body further comprises axially directed grooves and circumferentially directed grooves and wherein the plunger comprises at least one lug engaging a respective groove in the switch body whereby axial movement of the lug follows axially directed grooves and rotational movement follows circumferentially directed grooves.

15. The light source of claim 1 wherein the actuator means comprises a plunger axially movable within the switch body and wherein rotation of the plunger from a first angular position to a second angular position substantially prevents axial movement of the plunger.

16. The light source of claim 15 wherein the coupling means comprises an axially and rotatably movable rotor having at least one follower surface and wherein the plunger comprises projection means including a cam surface for bearing against the follower surface on the axially and rotatably movable member.

17. The light source of claim 16 further comprising guide surfaces inside the switch body including a groove for guiding the projection means and wherein the follower surface on the rotor is defined by projection means on the rotor.

18. The light source of claim 17 wherein rotation of the plunger substantially disengages projections of the plunger from projections of the rotor.

19. The light source of claim 15 wherein the plunger moves axially toward the housing to turn on the portable light source.

20. The light source of claim 15 wherein the rotational movement produces an audible click.

21. The light source of claim 20 wherein the plunger comprises a projection and wherein the rotational movement causes the projection to cross a detent.

22. In a portable light source such as a flashlight which includes a housing for carrying a power supply, the power supply having first and second power supply electrodes, a lamp bulb supported by the housing and having first and second lamp contacts wherein the first lamp contact electrically couples to the first power supply electrode, and conductor means electrically coupled to the second lamp contact wherein the power supply, the lamp bulb and the conductor means are connected in series to form an open circuit having first and second terminals, the improvement comprising:

a switch assembly including a switch body securable to the housing and actuator means axially movable relative to the switch body for electrically coupling and uncoupling the first and second terminals in the housing and thereby switching the lamp bulb on and off, wherein the actuator means comprises rotationally and axially movable contact means for electrically connecting the first and second terminals and rotation means for rotating the contact means, and wherein axial movement of the actuator means causes the rotation means to rotate the movable contact means to follow at least in part a rotational path.

23. The light source of claim 22 wherein the switch assembly further comprises a spring having one end in contact with the movable contact means.

24. The light source of claim 23 wherein the switch body comprises a conductive cylindrical element electrically coupled to the switch body so that contact of the movable contact means with the conductive cylindrical element electrically connects the first and second terminals.

25. The light source of claim 24 wherein the rotation means comprises rotor means for using axial movement of the actuator means to impart rotational movement to the contact means and plunger means for imparting axial movement to the rotor means.

26. The light source of claim 25 wherein the switch assembly further comprises rotatable means for preventing axial movement of the plunger means and rotor means upon rotation of the rotatable means.

27. The light source of claim 26 wherein the spring biases the power supply away from the switch and wherein the housing is an electrically conductive battery cell tube.

28. In a portable light source such as a flashlight which includes holding means for holding a power supply having first and second terminals, and a lamp bulb for producing light upon passage of a current through the lamp bulb between first and second terminals wherein the first terminal of the lamp bulb is electrically coupled with the first terminal of the power supply, and a conductor electrically coupled to the second terminal of the lamp bulb, an improved switch for electrically coupling the second terminal of the power supply with the second terminal of the lamp bulb, comprising:

a switch body, first conductive means at least partly inside the switch body for electrically coupling with the second terminal of the power supply, second conductive means substantially encircling and electrically insulated from the first conductive means for electrically coupling with the second terminal of the lamp bulb through the conductor, movable contact means in the switch body electrically coupled with only one of the first and second conductive means when the movable contact means is in a first axial position in the switch body and coupled to both of the first and second conductive means when in a second axial position, and axially movable actuator means extending within the switch body for moving the movable contact means between a first axial position and a second axial position.

29. The light source of claim 28 wherein the first conductive means comprises a spring extending out of the switch body for electrically coupling with the second terminal of the power supply.

30. The light source of claim 29 wherein the switch body is electrically conductive.

31. The light source of claim 28 wherein the second conductive means comprises a conductive cylinder inside the switch body, wherein the switch further comprises an insulating bushing around the first conductive means wherein the switch body is electrically conductive and the holding means is electrically conductive and comprises the conductor electrically coupled to the second terminal of the lamp bulb.

32. The light source of claim 31 wherein the movable contact means comprises at least two arms for contacting the second conductive means when the movable contact means is in the second axial position.

33. The light source of claim 28 wherein the actuator means comprises a plunger in the switch body for moving axially to switch the light source on and off and a rotor for supporting the second conductive means and moving the second conductive means upon axial movement of the plunger.

34. The light source of claim 33 wherein the rotor turns during a part of the axial movement of the plunger.

35. The light source of claim 34 wherein the actuator means further comprises a sleeve, and wherein the plunger comprises projections for engaging the sleeve upon rotation of the plunger for preventing axial movement of the plunger.

36. A switch for a flashlight having first and second terminals of a circuit separated from each other by the switch and including in the circuit a power supply and a light source, the switch comprising first conductor means for coupling the switch to the first terminal of the circuit, second conductor means for coupling the switch to the second terminal of the circuit, a switch body enclosing at least in part the first and second conductor means, and actuator means axially movable relative to the switch body between an off position and an on position for electrically coupling the first conductor means to the first terminal and electrically coupling the second conductor means to the second terminal in the on position, thereby completing the circuit, and rotatably movable relative to the switch body in the off position wherein rotation of the actuator means relative to the switch body from a first angular position to a second angular position substantially prevents axial movement of the actuator means and thereby locks the switch.

37. In a portable light source such as a flashlight having a barrel for carrying a power supply having first and second power supply electrodes, a bulb enclosure supported by the barrel, a lamp bulb in the bulb enclosure having first and second lamp contacts wherein the first lamp contact electrically couples to the first power supply electrodes, and conductor means electrically coupled to the second lamp contact wherein the power supply, the bulb and the conductor means are connected in series to form an open circuit having first and second terminals, the improvement comprising:

a switch assembly threadably engagable with an end of the barrel and including a conductive switch body having first and second ends, external threads on the first end for engaging the end of the barrel and for electrically coupling with the first terminal and having at least one wall defining a bore through the switch body between first and second ends, a sleeve having electrically insulated portions within the bore part way between the first and second ends, a contact in the bore movable from the insulated portions of the sleeve to a point electrically coupled to the switch body, an electrically conductive spring in electrical contact with the contact, biasing the contact in a direction toward the second end of the switch body and extending from the first end of the switch body for contacting the second terminal, a guide sleeve in the switch body between the insulated sleeve and the second end of the switch body, a rotor guided by the guide sleeve for moving the contact from the insulated portions of the sleeve to electrically couple with the switch body, a link member axially and rotatably movable in the bore for moving the rotor, and a push-button extendable and movable axially over the outside of the second end of the switch body opposite the threads and axially and rotatably fixed to the link member such that rotational movement of the push-button rotates the link member and axial movement of the push-button axially moves the link member and wherein rotational movement of the push-button to a first push-button position prevents substantial axial movement of the link member.

38. In a portable light source such as a flashlight having a barrel for carrying a power supply having first and second power supply electrodes, a bulb enclosure supported by the barrel, a lamp bulb in the bulb enclosure having first and second lamp contacts wherein the first lamp contact electrically couples to the first power supply electrode, and conductor means electrically coupled to the second lamp contact wherein the power supply, the bulb and the conductor means are connected in series to form an open circuit having first and second terminals, the improvement comprising:

a switch assembly threadably engagable with an end of the barrel and including a conductive switch body having first and second ends, external threads on the first end for engaging the end of the barrel and for electrically coupling with the first terminal and having at least one wall defining a bore through the switch body between first and second ends, an electrically conductive annular surface electrically coupled to the switch body, an annular electrically insulated sleeve between the electrically conductive annular surface and the second end, an electrical contact in the bore movable from within the insulated sleeve to a point outside the insulated sleeve into electrical contact with the electrically conductive annular surface, an electrically conductive spring in electrical contact with the contact, biasing the contact in a direction toward the second end of the switch body and extending from the first end of the switch body for contacting the second terminal, a guide sleeve in the switch body between the insulated sleeve and the second end of the switch body, a rotor guided by the guide sleeve for moving the contact from the insulated portions of the sleeve to electrically couple with the switch body, a link member axially and rotatably movable in the bore for moving the rotor, and a push-button extendable and movable axially over the outside of the second end of the switch body opposite the threads and axially fixed to the link member such that axial movement of the push-button axially moves the link member.

* * * * *